US009534352B2

(12) United States Patent
Kusama

(10) Patent No.: US 9,534,352 B2
(45) Date of Patent: Jan. 3, 2017

(54) BOOM FOR WORKING MACHINE WITH SWELLING PART

(71) Applicant: KUBOTA CORPORATION, Osaka-shi (JP)

(72) Inventor: Kenzo Kusama, Sakai (JP)

(73) Assignee: KUBOTA CORPORATION, Osaka-shi (JP)

( * ) Notice: Subject to any disclaimer, the term of this patent is extended or adjusted under 35 U.S.C. 154(b) by 109 days.

(21) Appl. No.: 14/313,121

(22) Filed: Jun. 24, 2014

(65) Prior Publication Data

US 2015/0003949 A1 Jan. 1, 2015

(30) Foreign Application Priority Data

Jun. 28, 2013 (JP) ..... 2013-136526
Sep. 25, 2013 (JP) ..... 2013-198428

(51) Int. Cl.
*E02F 3/38* (2006.01)
*E02F 9/22* (2006.01)

(52) U.S. Cl.
CPC ..... *E02F 3/38* (2013.01); *E02F 9/2275* (2013.01)

(58) Field of Classification Search
CPC ..... E02F 3/382; E02F 9/006; E02F 9/2275
See application file for complete search history.

(56) References Cited

U.S. PATENT DOCUMENTS 6,684,537 B2 * 2/2004 Ichikawa ..... E02F 9/2275 37/347
7,008,169 B1 * 3/2006 Miyanishi ..... E02F 9/2275 414/685
7,682,124 B2 * 3/2010 Miyazaki ..... E02F 9/2275 414/694
2003/0210972 A1 * 11/2003 Yukawa ..... E02F 9/2275 414/394

FOREIGN PATENT DOCUMENTS

CN 101589200 11/2009
JP 10331184 A * 12/1998
JP 2000345582 A * 12/2000
JP 2004-176312 6/2004

* cited by examiner

*Primary Examiner* — Gerald McClain
(74) *Attorney, Agent, or Firm* — Greenblum & Bernstein, P.L.C.

(57) ABSTRACT

Boom for a working machine includes a forked base support pivotally supported by a machine body. A base support of the boom has a hose introduction hole for inserting a hydraulic hose from the machine body into the boom main body. A swelling part extends upward from a fore end side toward a forked side so as to correspond to an inner surface side of an upper wall and skirt parts extend downward from a lateral center of a top part of the swelling part toward upper surfaces of left and right leg parts.

3 Claims, 13 Drawing Sheets

BOOM FOR WORKING MACHINE WITH SWELLING PART

CROSS-REFERENCE TO RELATED APPLICATION

The instant application is based upon the Japanese priority Patent Application Nos. JP 2013-198428, filed Sep. 25, 2013, and JP 2013-136526, filed Jun. 28, 2013, the disclosures of which are hereby incorporated by reference thereto, and the priority of which is hereby claimed under 35 U.S.C. §119.

TECHNICAL FIELD

The present invention relates to a boom provided for a working machine such as a backhoe.

BACKGROUND ART

There has been disclosed a backhoe in Japanese Unexamined Patent Publication JP-A2004-176312 as a working machine. The boom of the backhoe includes a forked base support of which the base end side is pivotally supported by the revolving base and the fore end side is connected with a boom main body. The base support is configured to include a body part, and a left and right pair of leg parts that are extended from the body part to the revolving base and swingably pivotally supported on the revolving base side. Also, hydraulic hoses on the revolving base side are inserted between the left and right pair of leg parts, extended to the upper surface of the body part, and further extended along the outer surface of the boom main body to the fore end side of the arm. Hydraulic oil is supplied through the hydraulic hoses to hydraulic actuators such as a hydraulic actuator for actuating the arm swingably supported on the fore end side of the boom main body.

Also, in this backhoe, the revolving base is provided with a swing bracket rotatably around a vertical shaft, and the swing bracket vertically movably supports the base part of the boom through a horizontal pivot. The boom is provided with the swingable arm, and the fore end of the arm is provided with the bucket. The arm provided at the fore end of the boom, and the boom are actuated by the hydraulic actuators such as hydraulic cylinders.

In such a backhoe, the multiple hydraulic hoses for supplying the hydraulic oil to the hydraulic actuators for actuating the arm, bucket, and the like are arranged from the revolving base via the boom along the outer surface of the boom.

SUMMARY OF INVENTION

Technical Problem

The backhoe in Japanese Unexamined Patent Publication JP-A2004-176312 is structured to extend the hydraulic hoses along the outer surface of the boom main body, and therefore the hydraulic hoses arranged along the outer surface of the boom main body may be damaged. Also, the backhoe is configured to arrange the hydraulic hoses outside the boom, and therefore the hydraulic hoses may interfere with a view during excavation.

One of ways to overcome such problems is to internally arrange the hydraulic hoses by providing a hose introduction hole for inserting the hydraulic hoses into the body part of the base support of the boom, and inserting the hydraulic hoses into the hose introduction hole to extend the hydraulic hoses from the body part of the base support toward the boom main body.

However, in the case where the boom is vertically swung, the hydraulic hoses located between the left and right pair of leg parts are raised upward (the vertical swing of the boom bends the hydraulic hoses to raise the hydraulic hoses), and inserted into the hose introduction hole obliquely from above. That is, when the boom is vertically swung, the hydraulic hoses are inserted into the hose introduction hole at a steep angle, and come into strong contact with part of the hose introduction hole, and thereby damage to the hydraulic hoses may occur.

Also, in the case of internally arranging the hoses, a large-sized backhoe may be required to ensure the strength of a boom.

The present invention is intended to provide a boom for a working machine to make it possible to solve the problems. That is, the present invention is intended to provide a boom for a working machine, which even in the case of internally arranging hydraulic hoses, makes it possible for the hydraulic hoses to smoothly move along part of a hose introduction hole when the boom is vertically swung. Further, the present invention is intended to provide a boom for a working machine making it possible to arrange hydraulic hoses inside a boom main body while reinforcing the boom main body.

Solution to Problem

Technical means taken by the present invention in order to solve the technical problems are characterized by the following points.

According to the technical means of the present invention, a boom for a working machine includes a forked base support (a two-forked base support) of which a base end side is pivotally supported by a machine body and a fore end side is connected with a boom main body, and the base support includes: a body part that has a hose introduction hole for inserting a hydraulic hose from the machine body into the boom main body; and a left and right pair of leg parts that are extended in a forked shape from the body part toward the machine body, and swingably pivotally supported on a machine body side. In addition, the body part includes: sidewalls that are connected with the left and right leg parts; an upper wall that connects between upper parts of the left and right sidewalls; and a lower wall that connects between lower parts of the left and right sidewalls, and a part surrounded by the left and right sidewalls, the upper wall, and the lower wall is configured as a hose introduction hole.

Further, on an inner surface side of the upper wall of the body part, an enlarged opening part that gradually extends upward from the fore end side toward a forked side is formed, whereas on an outer surface side of the upper wall of the body part, a swelling part that extends upward from the fore end side toward the forked side so as to correspond to the inner surface side of the upper wall, and skirt parts that gradually extend downward from a lateral center of a top part of the swelling part toward upper surfaces of the left and right leg parts are formed.

According to the technical means of the present invention, inner surfaces of the left and right sidewalls of the body part are swelled inward to form the sidewalls thicker.

According to the technical means of the present invention, the sidewalls and the left and right leg parts include: thin wall parts formed by reducing thicknesses of the sidewalls and the leg parts on outer lateral surface sides; and on upper sides of the sidewalls and the left and right leg parts, upper thick wall parts having a larger thickness than the thin wall parts, and a vertical width of the upper thick wall parts is gradually increased from the left and right leg parts toward the sidewalls of the body part.

According to the technical means of the present invention, a boom for a working machine includes a boom main body formed by connecting upper parts of a left and right pair of sidewall parts to each other through a top wall part, and connecting lower parts of the left and right side wall parts to each other through a bottom wall part, and is provided with a partition inside the boom main body and in a longitudinal middle of the boom main body. In addition, in the partition, a hose hole inserted with a hydraulic hose arranged inside the boom main body is formed. Further, the partition includes: a lower plate part welded to the bottom wall part; and a vertical plate part that is raised from the lower plate part and welded to the sidewall parts, and the hose hole is formed from the vertical plate part to the lower plate part via a first bending part between the vertical plate part and the lower plate part.

According to the technical means of the present invention, the partition includes an upper plate part that bends at an upper end of the vertical plate part and extends in a longitudinal direction of the boom main body, and the hose hole is formed from the vertical plate part to the upper plate part via a second bending part between the vertical plate part and the upper plate part.

According to the technical means of the present invention, between the vertical plate part and the lower plate part, reinforcing plates for reinforcing the partition are provided, and respectively welded to the sidewall parts According to the technical means of the present invention, an edge part of the hose hole formed on a lower plate side is configured as a non-welding part with respect to the bottom wall part.

According to the technical means of the present invention, the first bending part is configured as a non-welding part with respect to the sidewall parts.

According to the technical means of the present invention, the partition is provided on each of both sides of the main body bending part formed in the longitudinal middle of the boom main body.

Advantageous Effects of Invention

According to the present invention, the following effects are produced.

According to the present invention, on the inner surface side of the upper wall of the body part, the enlarged opening part gradually extending upward from the fore end side toward the forked side is formed, and thereby even in the case where the boom is vertically swung, damage to the hose can be prevented because the hydraulic hose moves along the upper wall inner surface of the enlarged opening part. In addition, on the outer surface side of the upper wall of the body part, the swelling part extending upward toward the forked side so as to correspond to the upper wall inner surface side, and the skirt parts gradually extending downward from the lateral center of the top of the swelling part toward the upper surfaces of the leg parts are formed, and therefore the rigidity around the enlarged opening part (the rigidities of the sidewalls and the upper wall) can be improved.

Also, the inner surfaces of the left and right sidewalls of the body part are swelled inward to form the sidewalls thicker, and therefore the rigidities of the left and right sidewalls near the enlarged opening part can be improved.

Further, at least the upper thick wall parts are extended from the leg parts toward the middle parts of the sidewalls of the body part, and in addition, the vertical width of the upper thick wall parts is gradually increased toward the body part, so that for example, the rigidities of the left and right sidewalls corresponding to the outer lateral surfaces of the base support can be improved.

Still further, the partition including: the lower plate part welded to the bottom wall part of the boom main body; and the vertical plate part welded to the sidewall parts of the boom main body is provided in the longitudinal middle of the boom main body, and thereby the strength of the boom can be improved by the partition. In addition, in the partition, the hose hole is provided, and consequently the hydraulic hose can be arranged inside the boom main body. Further, the hose hole is formed even to the lower plate part via the first bending part between the vertical plate part and the lower plate part, and therefore stress on the first bending part of the partition can be dispersed, i.e., stress concentration can be avoided.

Also, the upper plate that bends at the upper end of the vertical plate part and extends in the longitudinal direction of the boom main body is provided, and in addition, the hose hole is formed from the vertical plate part to the upper plate part via the second bending part between the vertical plate part and the upper plate part, so that the hose hole can be increased in size, and in addition, stress on the second bending part of the partition can be dispersed.

Further, the reinforcing plates for reinforcing the partition are provided between the vertical plate part and the lower plate part, making it possible to improve the rigidity of the partition, and in addition, the reinforcing plates are respectively welded to the sidewall parts, making it possible to improve the strength of the boom main body by the reinforcing plates as well.

Still further, the periphery of the edge part of the hose hole can be deformed along with the deformation of the boom main body.

Yet further, stress concentrated on the first bending part can be dispersed.

Yet still further, the strength of the boom main body can be improved, and in addition, the hydraulic hose can be easily inserted from any of the base end side and fore end side of the boom main body.

DESCRIPTION OF EMBODIMENTS

Embodiments of the present invention will hereinafter be described with reference to the drawings.

First Embodiment

Figure 10:
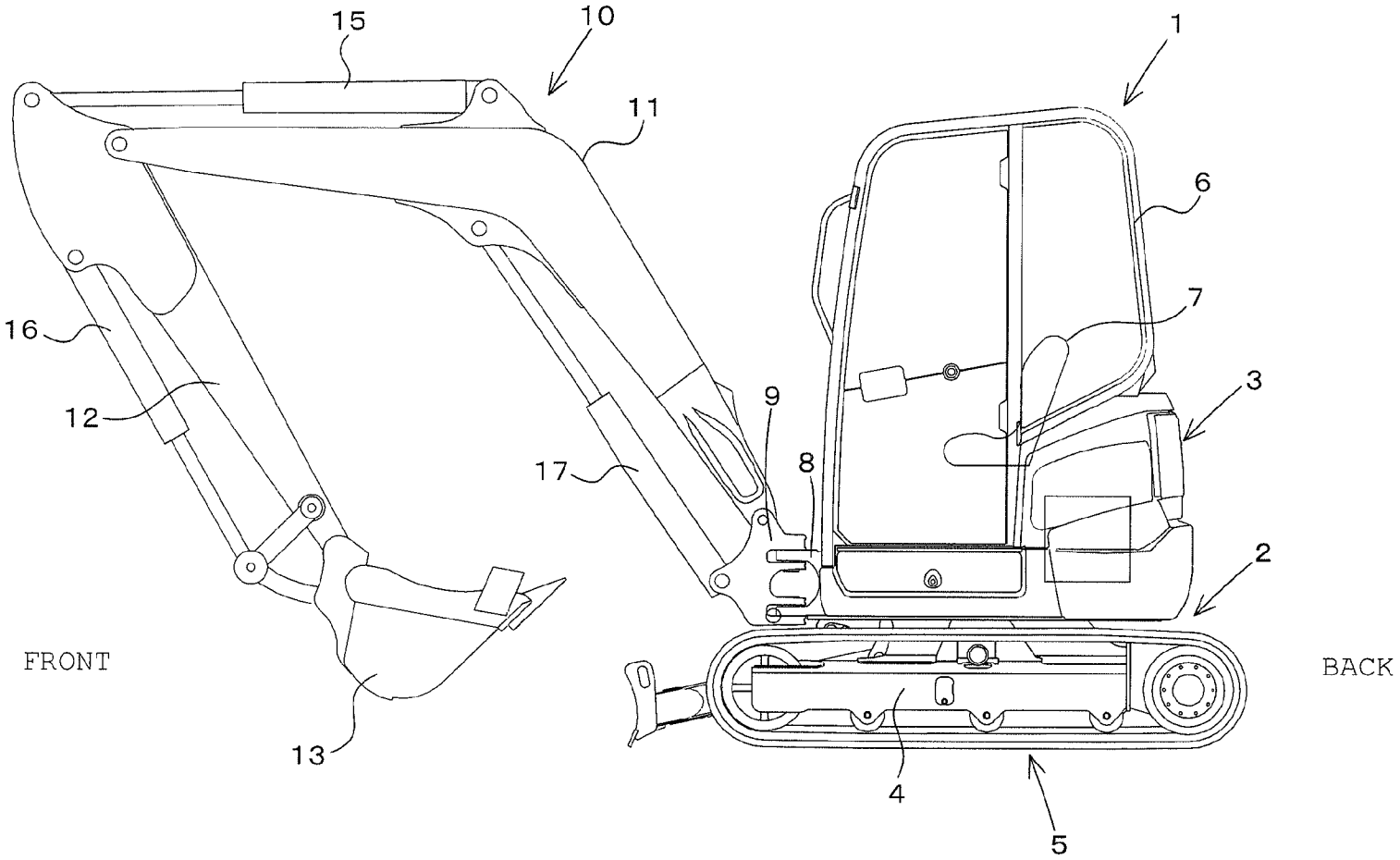
FIG. 10 is an overall side view of a backhoe.

FIG. 10 illustrates a working machine (backhoe) including a boom of the present invention.

As illustrated in FIG. 10, the backhoe 1 has a traveling device 2 on the lower side, and a revolving base 3 (machine body) that is supported by the traveling device 2 revolvably around a vertical shaft. Note that the working machine is not limited to the backhoe illustrated in FIG. 10. Also, in this embodiment, the front side (left side in FIG. 10) of an operator sitting on an operator's seat 7 of the working machine, the back side of the operator (right side in FIG. 10), the left side of the operator, and the right side of the operator are respectively defined as the front, back, left, and right to proceed with the description.

The traveling device 2 includes truck frames 4 on both of the left and right sides, and the left and right truck frames 4 are respectively attached with crawler type traveling devices 5.

On the revolving base 3, a cabin 6 is mounted, and in the cabin 6, the operator's seat 7 is provided. A support bracket 8 provided on the front side of the revolving base 3 supports a swing bracket 9 swingably left and right.

On the front side of the revolving base 3, an operating unit 10 is provided. The operating unit 10 has a boom 11, an arm 12, and a bucket 13. The base side of the boom 11 is pivotally supported by the swing bracket 9. The boom 11 is vertically swingably supported by a boom cylinder 17 provided between the swing bracket 9 and the boom 11, the arm 12 is swingably supported by an arm cylinder 15 provided between the boom 11 and the arm 12, and the bucket 13 is supported by a bucket cylinder 16 provided between the arm 12 and the bucket 13 so as to be able to perform a scooping/dumping operation.

Figure 1:
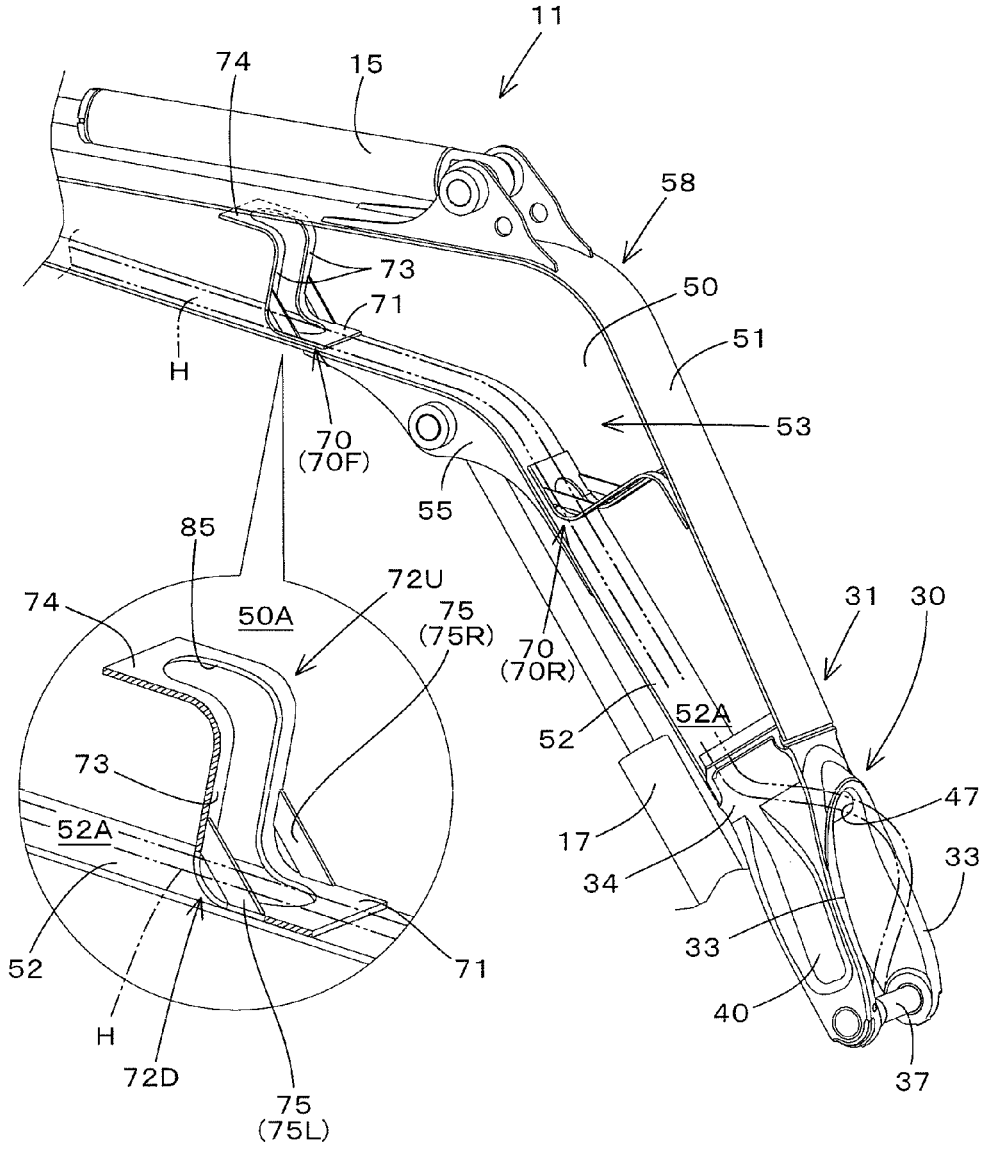
FIG. 1 is an internal perspective view of a boom in a first embodiment.
Figure 2:
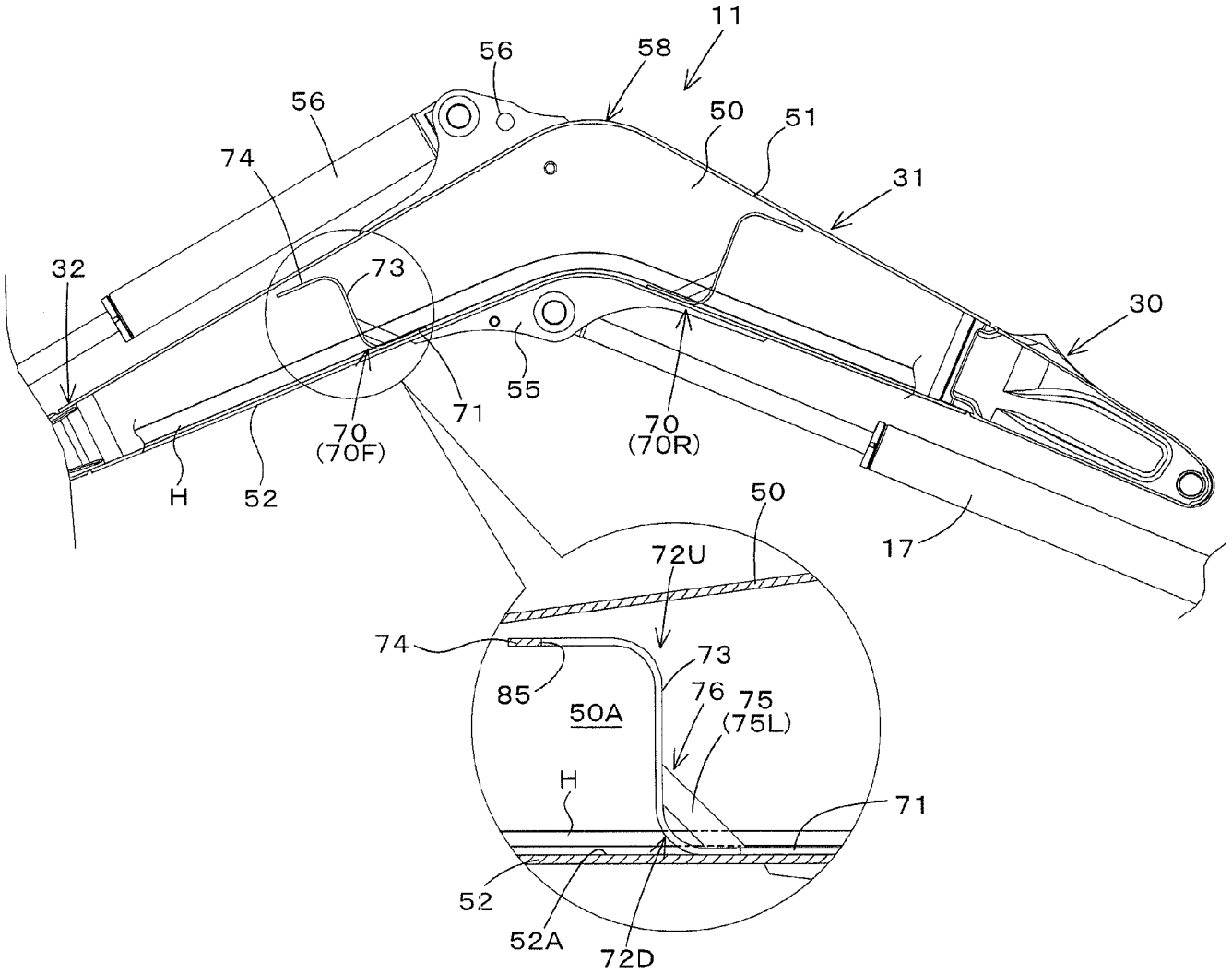
FIG. 2 is an internal side view of the boom in the first embodiment.

As illustrated in FIGS. 1 and 2, the boom 11 includes: a base support 30 that is pivotally supported by the swing bracket 9 at the base part (at the base side) and formed of a casting; a boom main body 31 that is connected to the base support 30 at the base side and formed of sheet metal; and a fore end support 32 that is connected to the fore end of the boom main body 31 and formed of a casting.

Figure 3:
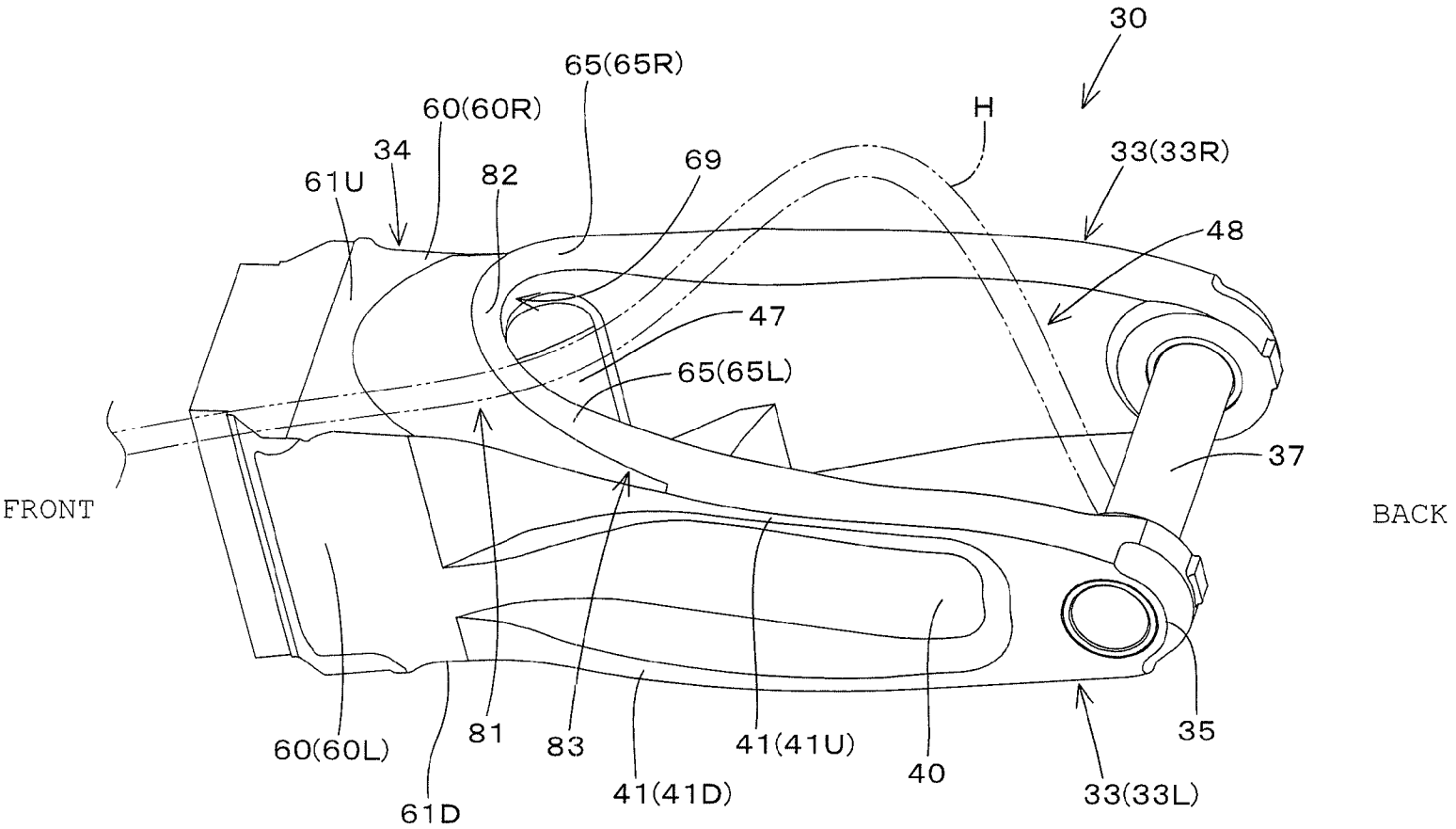
FIG. 3 is a perspective view of a base support in the first embodiment.
Figure 4A:
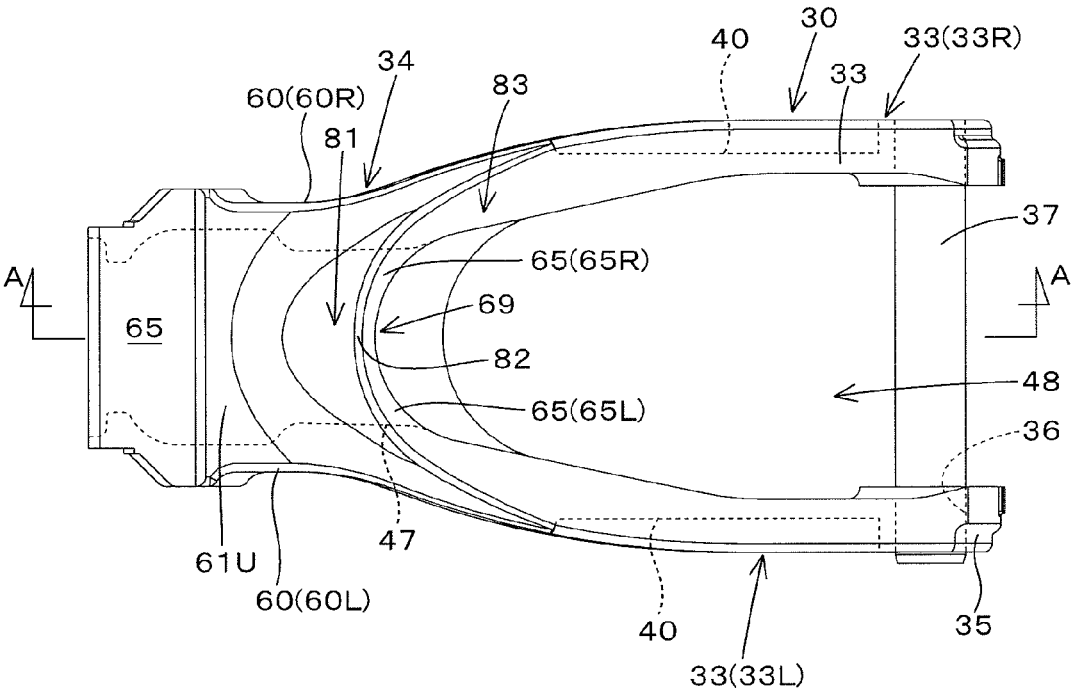
FIG. 4A is a plan view of the base support in the first embodiment.
Figure 4B:
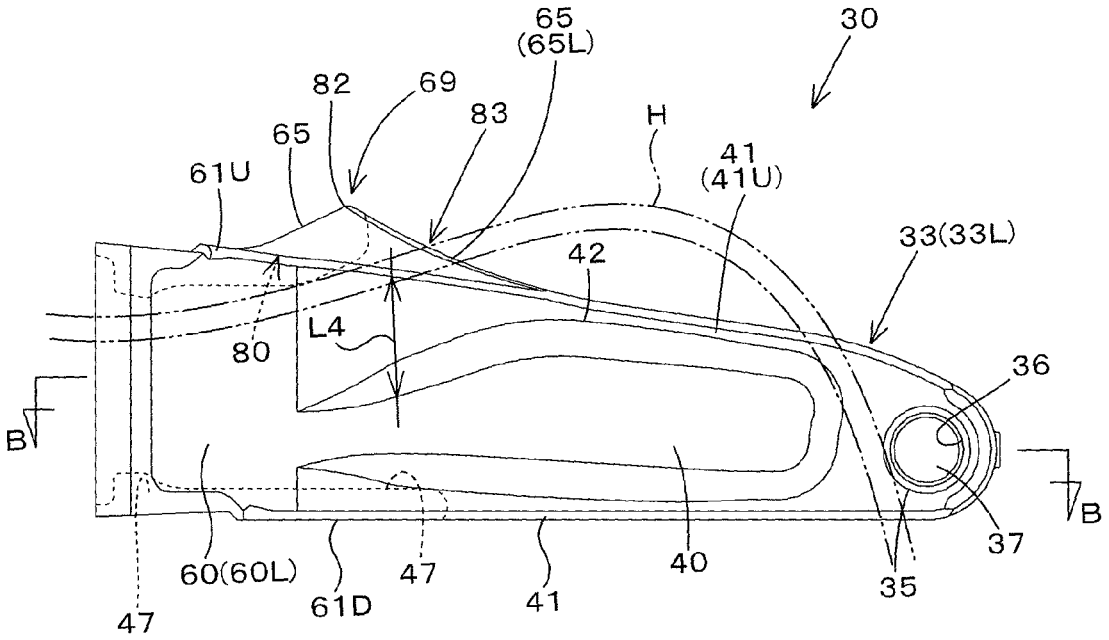
FIG. 4B is a side view of the base support in the first embodiment.

As illustrated in FIGS. 3 to 5, the base support 30 is formed in a forked shape in a plan view, and includes: a body part 34 having a hose introduction hole 47 for introducing hydraulic hoses H from the revolving base 3; and a left and right pair of leg parts 33 extended from the left and right of the base end of the body part 34 to the swing bracket 9. A part where the leg parts 33 forked from the body part 34 (near the boundaries between the base end side of the body part 34 and the fore ends of the leg parts 33) is referred to as a forked part (forked side) 69.

In a substantially horizontal position, the body part 34 includes: left and right sidewalls 60; an upper wall 61U connecting between the upper parts of the left and right sidewalls 60; and a lower wall 61D connecting between the lower parts of the left and right sidewalls 60. That is, in a state where the central axis of the body part 34 is made horizontal to an installation surface (such as the ground), the body part 34 includes the left and right sidewalls 60, the upper wall 61U, and the lower wall 61D. A part surrounded by the left and right sidewalls 60, upper wall 61U, and lower wall 61D is configured as the hose introduction part 47.

More specifically, of the left and right sidewalls 60, the left sidewall 60L is connected with the fore end side of the left leg part 33L, and the right sidewall 60R is connected with the fore end side of the right leg part 33R. On the base sides of the left and right leg parts 33L and 33R, connecting boss parts 35 respectively protruding leftward and rightward are formed, and in the connecting boss parts 35, attachment holes 36 bored in the left-right direction (thickness direction) are formed. Further, by inserting a pivotally supporting shaft 37 into the attachment holes 36 and swing bracket 9, the base side of the boom 11 is pivotally supported by the swing bracket 9.

The hydraulic hoses H extending from the revolving base (machine body) 3 to the base support 30 first passes below the pivotally supporting shaft 37, passes between the left and right leg parts 33L and 33R, further enters the above-described hose introduction hole 47 corresponding to the part surrounded by the left and right sidewalls 60, upper wall 61U, and lower wall 61D, and then extends into the boom main body 31.

When the boom 11 is not vertically swung, the hydraulic hoses H are fitted between the left leg part 33L and the right leg part 33R. When the boom 11 is vertically swung, the hydraulic hoses H are bent, and raised in an inverted U-shape between the left leg part 33L and the right leg part 33R. That is, when the boom 11 is vertically swung, the hydraulic hoses H come out of an opening part 48 that is in an open state between the left leg part 33L and the right leg part 33R. In other words, the opening part 48 between the left leg part 33L and the right leg part 33R serves as a release part for releasing the hydraulic hoses H.

When the hydraulic hoses H are bent in the inverted U-shape, an insertion angle of the hydraulic hoses H to the hose introduction hole 47 becomes steep. In the case where the insertion angle of the hydraulic hoses H is steep, the hydraulic hoses H come into contact with the inner surface of the body part 34 forming the hose introduction hole 47, and thereby may be damaged. For this reason, in the present invention, by expanding the hose introduction hole 47 on the base end side, the damage to the hydraulic hoses H due to the insertion is prevented.

Next, the body part 34 including the hose introduction hole 47 is described in detail.

The upper wall 61U of the body part 34 extends upward from the middle part of the upper wall 61U in the front-back direction (or in a longitudinal direction) toward the back side (base end) so as to become distant from the lower wall 61D. That is, the inner surface 62 of the upper wall 61U (upper wall inner surface) includes: a horizontal part 62A that is substantially horizontal to the inner surface 63 of the lower wall 61D (lower wall inner surface); and an upward extension part 62B that is continuous with the horizontal part 62A and gradually extends upward so as to become distant from the lower wall inner surface 63. In other words, on the upper wall inner surface 62 side, a range L1 from an upward extension starting part 64 (at the boundary between the horizontal part 62A and the upward extension part 62B) where the upward extension is started to the top part 82 where the upward extension is ended corresponds to an enlarged opening part 80 where the hose introduction hole 47 is enlarged.

Also, the outer surface 65 of the upper wall 61U (upper wall outer surface) includes an upward extension part 65A that gradually extends upward parallel (or corresponding) to the upper wall inner surface 62. In other words, on the upper wall outer surface 65 side, a range L2 from an upward extension starting part 66 where the upward extension is started to the top part 82 where the upward extension is ended corresponds to a swelling part 81 that extends upward toward the forked part 69 so as to correspond to the upper wall inner surface 62.

After extending to the forked part 69, the upper wall outer surface 65 gradually extends downward from the central part of the forked part 69 in the left-right direction (or in a lateral direction) toward the upper surfaces of the leg parts 33.

That is, the left and right upper wall outer surfaces 65L and 65R, which are forked from the top part 82 corresponding to the uppermost swelled part of the upper wall outer surface 65, respectively extend toward the upper surfaces of the left and right leg parts 33L and 33R. The heights of the left and right upper wall outer surfaces 65L and 65R gradually decrease from the top part 82 toward the base end.

Further, in other words, the left and right upper wall outer surfaces 65L and 65R are respectively configured as skirt parts 83 that gradually extend downward from the laterally central part of the forked part 69 toward the upper surfaces of the leg parts 33.

As described above, in the base support 30, on the upper wall inner surface 62 side, the enlarged opening part 80 gradually extending upward from the fore end side toward the forked part 69 side is formed. On the other hand, on the upper wall outer surface 65 side, the swelling part 81 extending upward toward the forked part 69 so as to correspond to the upper wall inner surface 62 side is formed, and also the skirt parts 83 gradually extending downward from the laterally central part of the forked part 69 toward the upper surfaces of the leg parts 33 are formed. Accordingly, the enlarged opening part 80, swelling part 81, and skirt parts 83 form the upper wall side of the base support 30 in a dome shape.

As described, the enlarged opening part 80 enlarging the base end side of the hose introduction hole 47 is formed within the hose introduction hole 47, and therefore the hydraulic hoses H can be more easily inserted into the hose introduction hole 47 from above with the outer surfaces of the hydraulic hoses H introduced into the hose introduction hole 47 lying along the enlarged opening part 80 (the upward extension part 62B of the upper wall inner surface 62). For this reason, even in the case where the boom 11 is swung upward to bring the base support 30 and the swing bracket 9 close to each other, and consequently the bend of the hydraulic hoses H is strong, the hydraulic hoses H can be introduced along the enlarged opening part 80, and therefore trouble such as damage to the hydraulic hoses H can be prevented.

Figure 5A:
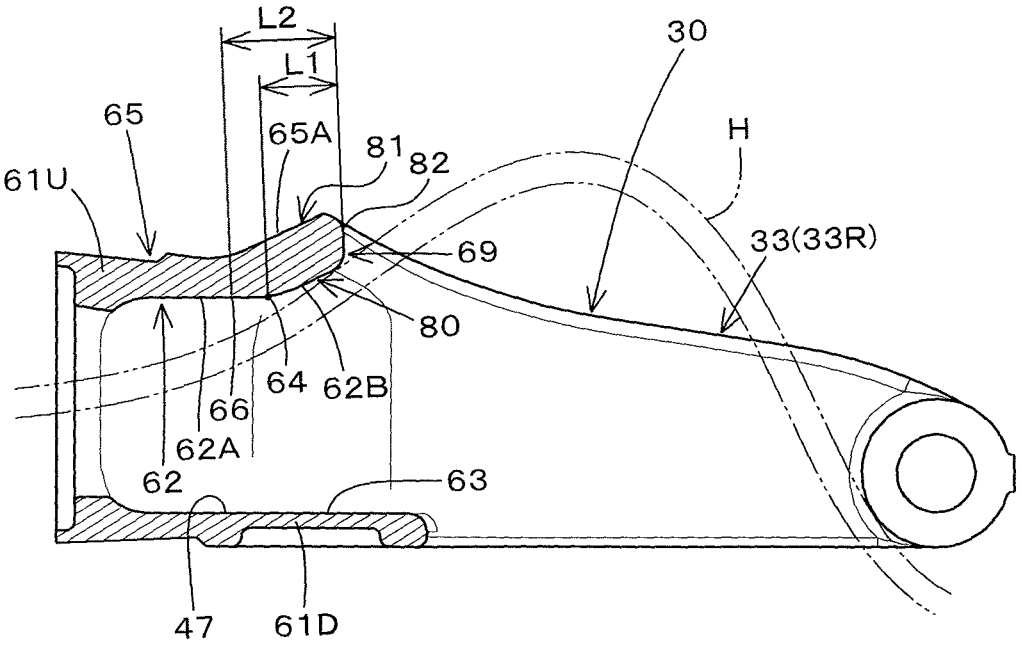
FIG. 5A is a cross-sectional view along the line A-A in FIG. 4A.
Figure 5B:
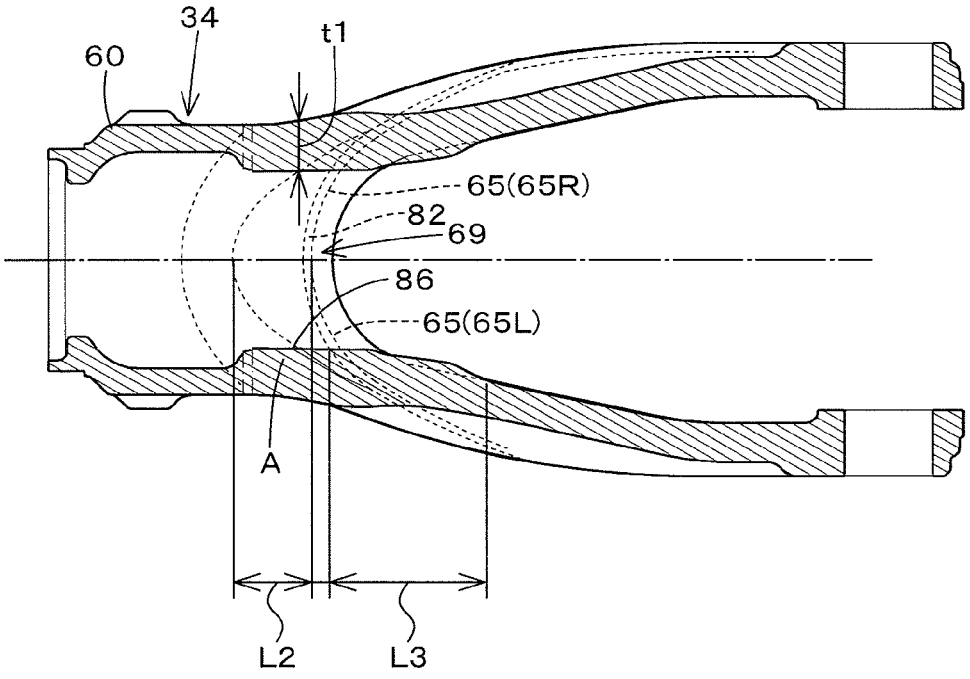
FIG. 5B is a cross-sectional view along the line B-B in FIG. 4B.

As illustrated in FIG. 5A and FIG. 5B, of the inner surfaces of the left and right sidewalls 60 (sidewall inner surfaces 86) of the body part 34, parts vertically overlapping with the enlarged opening part 80 are swelled inward to form the left and right sidewalls 60 thicker. That is, the thicknesses t1 of the left and right sidewalls 60 longitudinally overlapping in the range L1 from the upward extension starting part 64 to the top part 82 are made larger than the thicknesses of the rest of the left and right sidewalls 60.

Also, the upper wall outer surface 65 has the shape that forks into the two upper wall outer surfaces 65L and 65R at the top part 82, which respectively extend toward the upper surfaces of the leg parts 33, and parts of the left and right sidewalls 60 longitudinally overlapping with the upper wall outer surfaces 65 (65L and 65R) are swelled inward (range L3 in FIG. 5B).

That is, of the inner surfaces 86 of the sidewalls 60 constituting the hose introduction hole 47, the parts in the range (L2+L3) where the sidewalls 60 vertically overlap in the range L1 from the upward extension starting part 64 to the top part 82, and laterally overlap with the upper wall outer surfaces 65L and 65R are swelled inward to form the sidewalls 60 thicker than the rest of the sidewalls 60.

Meanwhile, when viewing the base support 30 from the side, in the vertically central parts of the base support 30, thin wall parts 140 having a reduced base support thickness are formed. The thin wall parts 140 are formed by reducing thicknesses of the vertically central parts of the leg parts 33 on the outer lateral surface sides as well as reducing thicknesses of the left and right sidewalls 60 continuous with the leg parts 33 on the outer lateral surface sides. Further, on the upper and lower sides of the vertically central parts of the leg parts 33 and body part 34, upper and lower thick wall parts 41U and 41D having a larger thickness than the thin wall parts 40 are formed.

Of the upper and lower thick wall parts 41U and 41D, at least the upper thick wall parts 41U extend from the leg parts 33 toward the middle parts of the left and right sidewalls 60 of the body part 34. The vertical width L4 of the upper thick wall parts 41U gradually increases toward the body part 34. In other words, when viewing the base support 30 from the side, the vertical width of the upper thick wall parts 41U respectively vertically overlapping with the skirt parts 83 is gradually increased from the base end side toward the fore end side. That is, upper ridge lines 42 corresponding to the boundaries between the thin wall parts 140 and corresponding ones of the upper thick wall parts 41U extend from the back side toward the front side along the upper surfaces of the leg parts 33 (upper surfaces of the upper thick wall parts 41U), and from the longitudinal middle, extend downward toward the front side.

As illustrated in FIGS. 1 and 2, the boom main body 31 includes: a left and right pair of sidewall parts 50; a top wall part 51 connecting between the upper ends of the left and right sidewall parts 50; and a bottom wall part 52 connecting between the lower ends of the left and right sidewall parts 50. The top wall part 51, left and right sidewall parts 50, and bottom wall part 52 are formed of a plate material, and by mutually welding the end parts of the wall parts 50, 51, and 52, the boom main body 31 is formed in a box shape (rectangular). In the following, a direction from the outside toward inside of the boom main body 31 is defined as an "inward" direction, and a direction from the inside toward outside of the boom main body 31 is defined as an "outward" direction to proceed with the description of the boom main body 31.

The top wall part 51, left and right sidewall parts 50, and bottom wall part 52 form a space part 53 in the boom main body 31 from the base end toward the fore end. The space part 53 can be inserted with the hoses (hydraulic hoses) H for supplying the hydraulic oil to the hydraulic actuators such as the arm cylinder 15. On the base end side of the boom main body 31, a hose introduction hole communicatively connected to the base support 30 to introduce the hoses from the base support 30 side is formed.

Also, the top wall part 51, left and right sidewall parts 50, and bottom wall part 52 are bent at the middle in the longitudinal direction to form the boom main body 31 in a dogleg shape. In the following, for convenience in description, the bending part of the boom main body 31 is referred to as a main body bending part (or simply the bending part) 58.

The vertical width of the left and right sidewall parts 50 gradually increases from the base end toward the main body bending part 58 to reach the maximum at the main body bending part 58 of the boom main body 31, and then gradually decreases from the main body bending part 58 toward the fore end. The lateral widths of the top and bottom wall part 51 and 52 are substantially uniformed from the base end to the fore end, and the main body bending part 58 of the top wall part 51 is provided with an upper support part 55 for supporting the base end side of the arm cylinder 15, whereas the main body bending part 58 of the bottom wall part 52 is provided with a lower support part 56 for supporting the fore end side of the boom cylinder 17.

On both sides of the main body bending part 58 inside the boom main body 31, partitions 70 for partitioning the inside the boom main body 31 are provided. That is, in the space part 53 from the fore end to bending part of the boom main body 31, a partition (first partition) 70F is provided, and in the space part 53 from the main body bending part 58 to base end of the boom main body 31, a partition (second partition) 70R different from the first partition 70F is provided.

The first and second partitions 70F and 70R are configured to be substantially Z-shaped as viewed from the side by bending a beltlike plate material in opposite directions along two lateral lines separated in the longitudinal direction. Each of the first and second partitions 70F and 70R includes: a lower plate part 71 that is fixed on the inner surface of the bottom wall part 52 by welding; a vertical plate part 73 that rises from the lower plate part 71 via a bending part (referred to as a first bending part 72D) and welded to the left and right sidewall parts 50; and an upper plate part 74 that extends from the vertical plate part 73 via a bending part (referred to as a second bending part 72U) in a direction different from an extending direction of the lower plate part 71.

Between the lower plate part 71 and the vertical plate part 73, a left and right pair of reinforcing plates 75 formed of a plate material is provided.

Specifically, the upper end of the left reinforcing plate 75L is welded to the left lower end of the vertical plate part 73, and the lower end of the left reinforcing plate 75L is welded on the left upper surface of the lower plate part 71. Also, the upper end of the right reinforcing plate 75R is welded to the right lower end of the vertical plate part 73, and the lower end of the right reinforcing plate 75R is welded on the right upper surface of the lower plate part 71. That is, the reinforcing plates 75 are provided across the first bending part 72D between the lower plate part 71 and the vertical plate part 73. The first and second partitions 70F and 70R having the left and right reinforcing plates 75L and 75R are welded on the inner surfaces 50A of the left and right sidewall parts 50 and on the inner surface 52A of the bottom wall part 52.

In part of at least the vertical plate part 73 of each of the first and second partitions 70F and 70R, a hose hole 85 for inserting the hydraulic hoses H arranged inside the boom main body 31 is formed.

Specifically, the hose hole 85 has a shape that is bored through the laterally central part of the vertical plate 73 throughout a vertical area (the entire area from the upper end to lower end of the vertical plate part 73), successively through the laterally central parts of the first and second bending parts 72D and 72U, and further successively through the lower and upper plate parts 71 and 74. That is, the hose hole 85 extends from the vertically central part of the vertical plate part 73 to the lower plate part 71 via the first bending part 72D, as well as extending from the vertically central part of the vertical plate part 73 to the upper plate part 74 via the second bending part 72U.

More specifically, when viewing the hose hole 85 from the side, one end side of the hose hole 85 is positioned on the lower plate part 71 side lower than a bending start line (a line where the curve starts) 86 at which the first bending part 72D starts, and the other end side of the hose hole 85 is positioned on the upper plate part 74 side higher than a bending start line (a line where the curve start) 87 at which the second bending part 72U starts. That is, the hose hole 85 extends from the lower end of the vertical plate part 53 to the first bending part 72D, and further extends into the lower plate part 71 in its thickness direction to reach the lower end of the hose hole 85.

As described above, in the boom main body 31, on the upper wall inner surface 62 side of the body part 34, the enlarged opening part 80 is formed, and therefore the hose introduction hole 47 is enlarged. On the other hand, when the boom 11 is vertically swung, the hydraulic hoses H are bent and raised upward, and protrude upward from the hose release part 48 to form into the inverted U-shape as viewed from the side. Even in the case where the hydraulic hoses H form into the inverted U-shape as described, the hydraulic hoses H lie along the upward extension part 62B, and therefore damage to the hydraulic hoses H due to contact between the body part 34 and the hydraulic hoses H can be prevented.

In addition, on the upper wall outer surface 65 side of the body part 34, the swelling part 81 is formed, and therefore the thickness of the upper wall 61U in the enlarged opening part 80 (swelling part) is increased. As a result, the rigidity of the fore end side of the upper wall 61U (rigidity around the enlarged opening part 80) can be improved. For this reason, a reduction in rigidity of the upper wall 61U due to the formation of the enlarged opening part 80 can be prevented. Further, the skirt parts 83 are formed to suppress the hydraulic hoses H from laterally stretching out, and therefore the hydraulic hoses H can be guided toward the forked part. Still further, the skirt parts 83 can reinforces the connecting parts between the leg parts 33 and the body part 34 (sidewalls), and thereby the rigidity of the whole of the base support 30, in particular, the rigidity near the enlarged opening part 80 can be improved.

Also, the inner surfaces of the left and right sidewalls 60 of the body part 34 are swelled inward to form the sidewalls 60 thicker, and therefore the rigidity around the enlarged opening part 80 can be improved. In particular, the rigidities at the boundaries between the upper wall inner surface 62 constituting the enlarged opening part 80 and the inner surfaces of the left and right sidewalls 60 can be improved.

Further, the thin wall parts 40 are formed in the vertically central parts of the base support 30, and the upper and lower thick wall parts 41U and 41D are formed on the upper and lower end sides of the vertically central parts. In addition, the upper thick wall parts 41U are extended from the leg parts 33 toward the middle parts of the sidewalls of the body part 34, and the vertical width of the upper thick wall parts 41 are gradually increased toward the body part 34. For these reasons, the rigidities of the left and right sidewalls 60 corresponding to the outer lateral surfaces of the base support 30 can be improved. In particular, the rigidities of the parts of the left and right sidewalls 60 vertically overlapping with the enlarged opening part 80 can be improved.

Second Embodiment

FIGS. 6 to 9 illustrate a boom for a working machine in a second embodiment. With use of FIGS. 6 to 9, the boom for a working machine in the second embodiment is described. Note that description of components common to the first and second embodiments are omitted here.

Figure 8A:
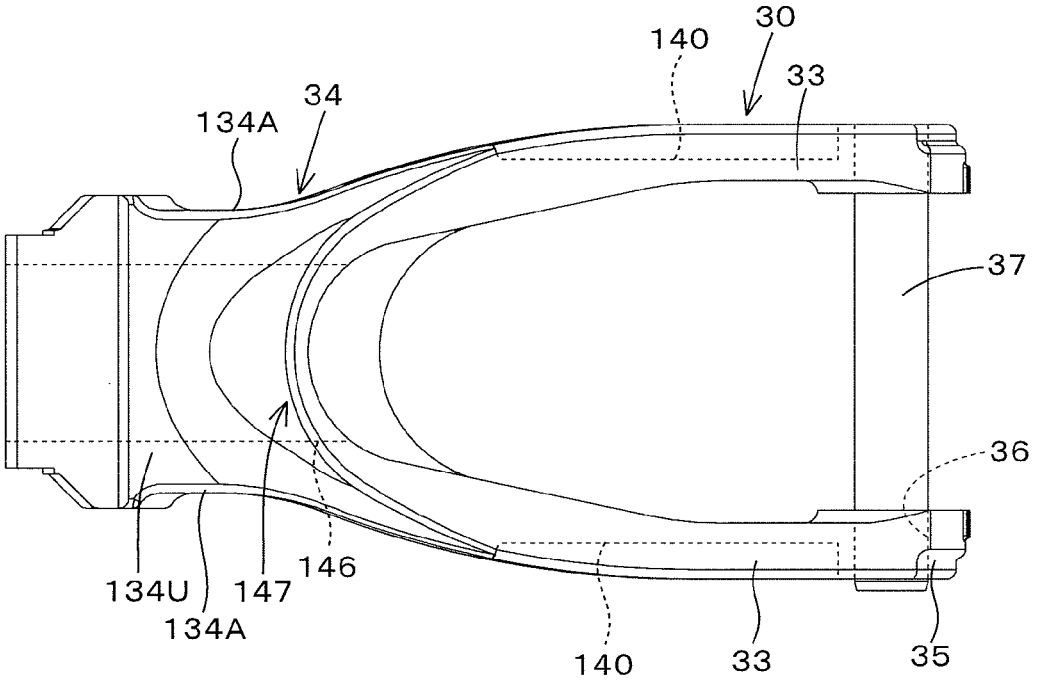
FIG. 8A is a plan view of a base support in the second embodiment.
Figure 8B:
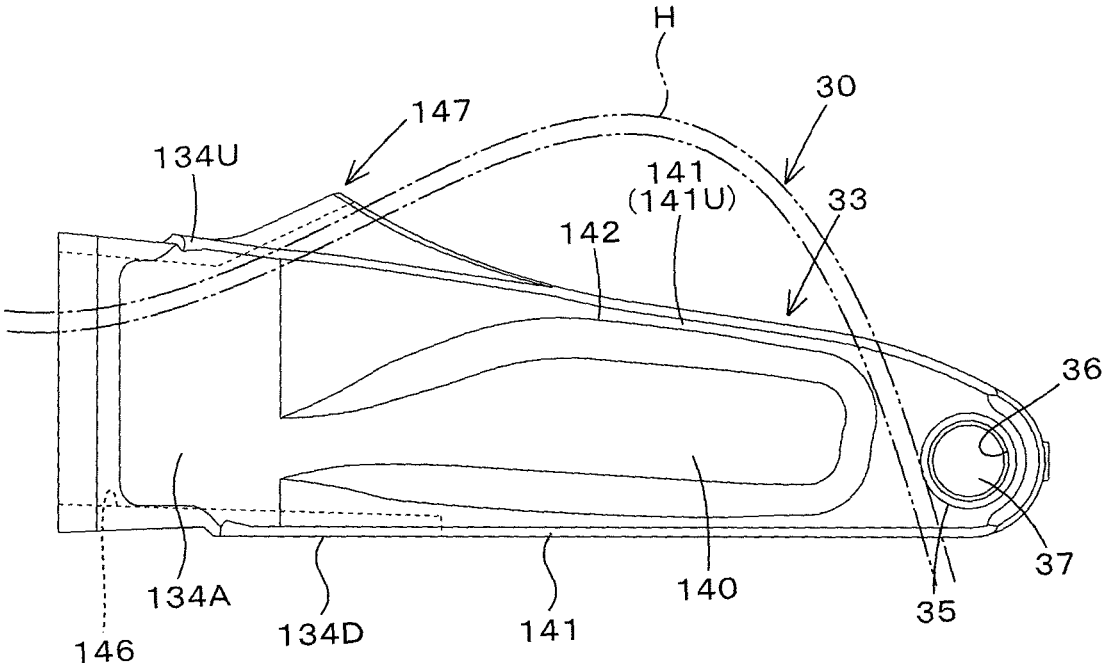
FIG. 8B is a side view of the base support in the second embodiment.

As illustrated in FIGS. 8A and 8B, the body part 34 includes: a left and right pair of side parts (left and right sidewalls) 134A; an upper wall 134U connecting between the upper parts of the left and right pair of side parts 134A; and a lower wall 134D connecting between the lower parts of the left and right pair of side parts 134A. A part surrounded by the left and right pair of side parts 134A, upper wall 134U, and lower wall 134D is configured as a hose introduction hole 146.

The upper wall 134U includes a dome part 147 that extends upward from the upper parts of the side parts 134A. Specifically, the dome part 147 is formed in a dome shape that extends upward from the front side toward back side of the body part 34, as well as gradually extends leftward and rightward from the top of the dome part 147.

The leg parts 33 respectively include thin wall parts 140 that are formed by concaving the vertically middle parts of the leg parts 33 on the outer lateral surface sides in a thickness direction by a predetermined width. The thin wall parts 140 are extended from the back sides of the connecting boss parts 35 toward the front side, and above and below the thin wall parts 140, pairs of thick wall parts 141 having a larger thickness are formed. The thin wall parts 140 and the pairs of thick wall parts 141 are extended from the leg parts 33 to the side parts 134A of the body part 34, respectively.

The upper thick wall parts 141U are formed so as to keep the vertical size (vertical width) uniform from the base side toward the front side, and gradually increase the vertical width from the longitudinally middle parts. That is, upper ridge lines 142 corresponding to the boundaries between the thin wall parts 140 and the upper thick wall parts 141U extend from the back side to the front side along the upper surfaces of the leg parts 33 (the upper surfaces of the upper thick wall parts 141U), and from the longitudinally middle parts, extend downward toward the front side, respectively.

The space part 53 inside the boom main body 31 is communicatively connected to the hose introduction hole 146 formed in the base support 30 (body part 34). The space part 53 can be inserted with the hydraulic hoses H that are guided after having passed through the hose introduction hole 146 of the body part 34 from the revolving base 3. Specifically, in the space part 53, for example, six hydraulic hoses H for supplying hydraulic oil to service ports provided at fore ends of the arm cylinder 15, bucket cylinder 16, and arm 12 are arranged. The first and second partitions 70F and 70R arranged inside the boom main body 31 are welded on the inner surfaces 50A of the left and right sidewall parts 50 and on the inner surface 52A of the bottom wall part 52.

Next, the arrangement and welding fixation of the first and second partitions 70F and 70R are described.

Figure 6:
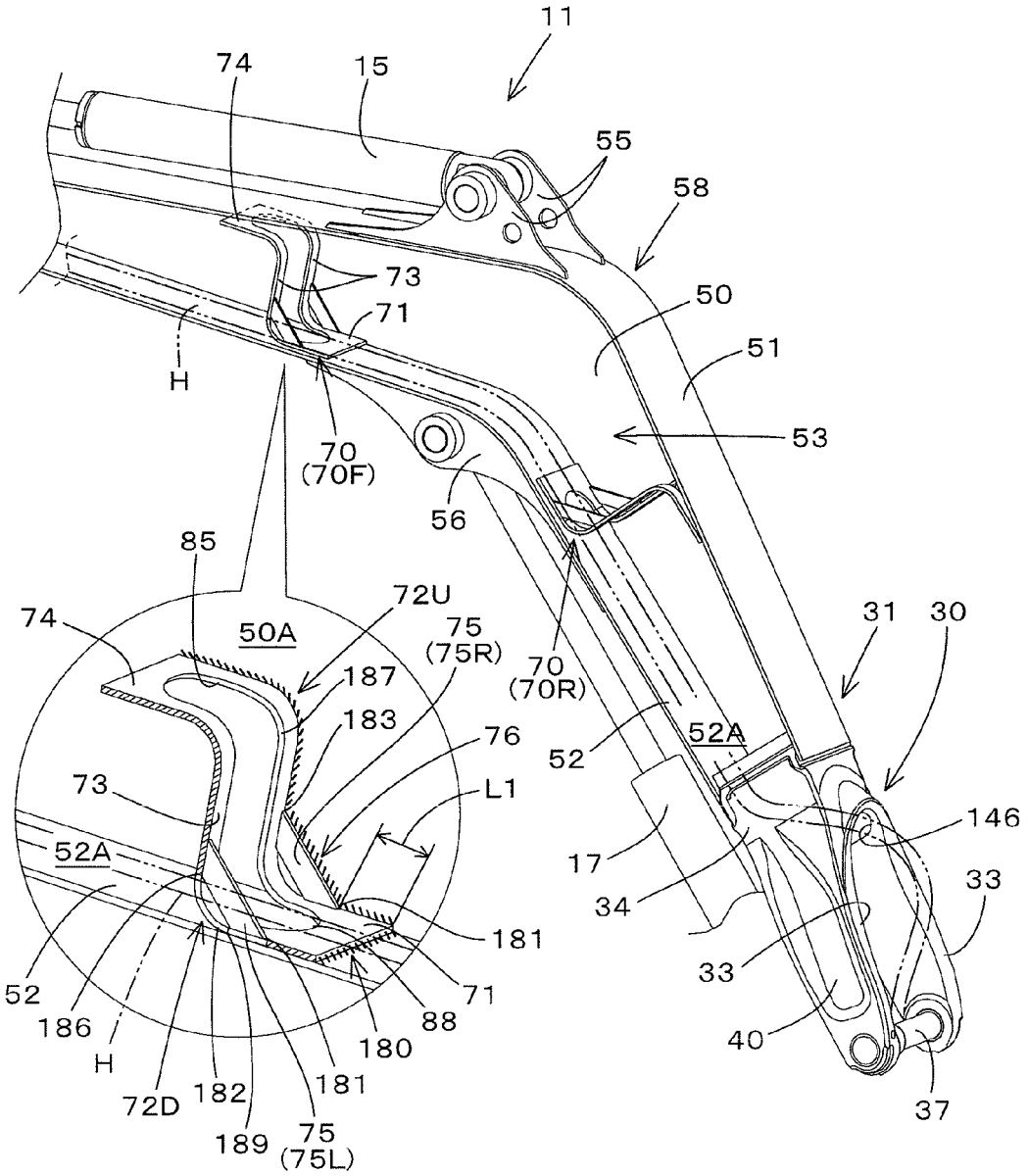
FIG. 6 is an internal perspective view of a boom in a second embodiment.
Figure 7:
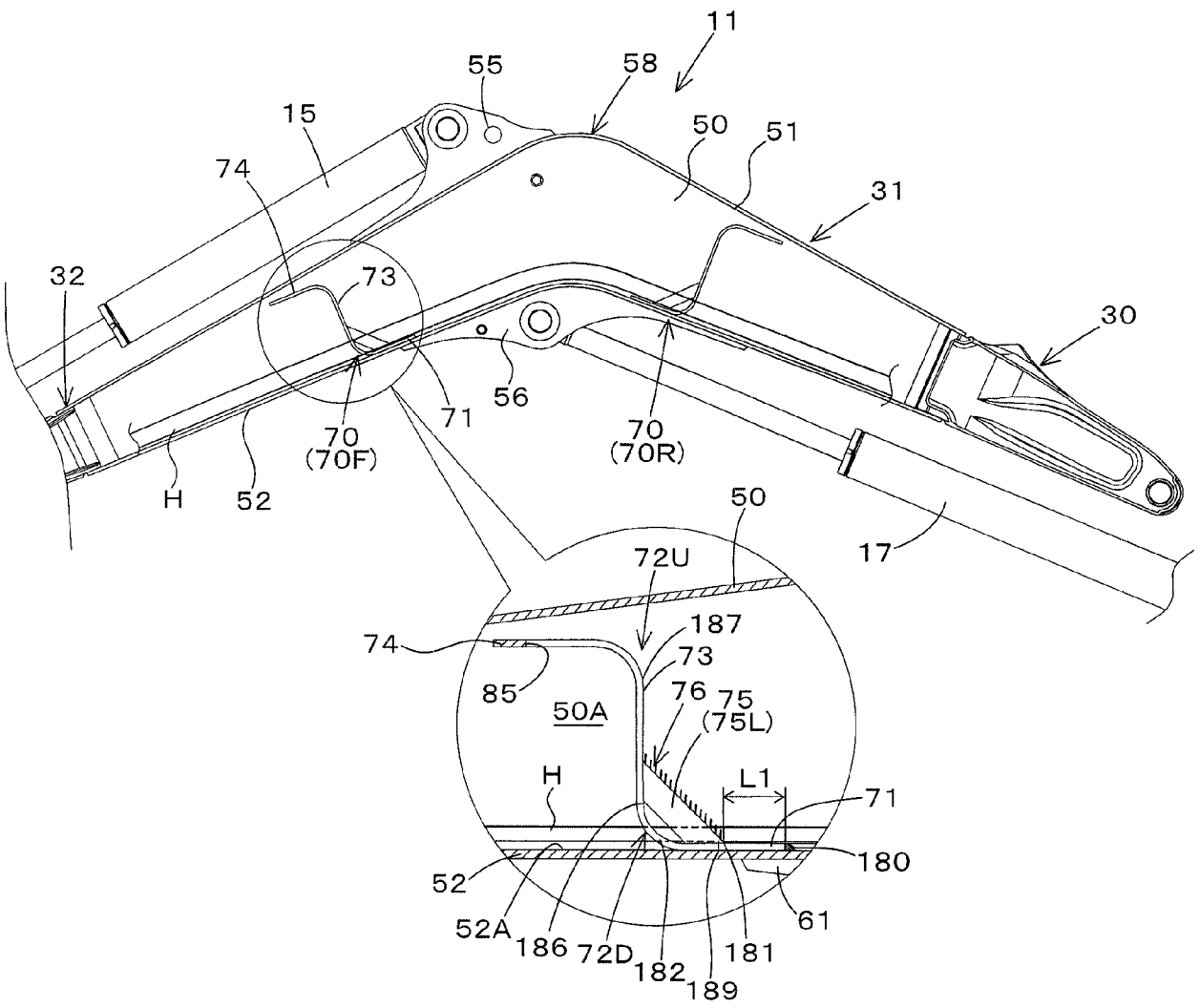
FIG. 7 is an internal side view of the boom in the second embodiment.

As illustrated in FIGS. 6 and 7, in each of the first and second partitions 70F and 70R, the left and right outer lateral surfaces of the left and right reinforcing plates 75L and 75R face to the inner surfaces 50A of the left and right sidewall parts 50, and the upper surfaces of the left and right reinforcing plate 75L and 75R are configured as welding parts 76 welded on the inner surfaces 50A of the left and right sidewall parts 50, respectively.

Also, the lower surface of the lower plate part 71 faces to the inner surface 52A of the bottom wall part 52, and the base end of the lower plate part 71 is configured as a welding part 180 welded on the inner surface 52A of the bottom wall part 52 by a predetermined width. By welding the base end of the lower plate part 71 on the inner surface 52A of the bottom wall part 52, a step (boundary area) between the lower plate part 71 and the bottom wall part 52 is smoothed through the welding part 180, and therefore the hydraulic hoses H can more easily pass from the inner surface 52A of the bottom wall part 52 to the upper surface of the lower plate part 71 through the upper surface of the welding part 180.

Also, both of the left and right ends of the lower plate part 71 face to the inner surfaces 50A of the left and right sidewall parts 50. The both left and right ends of the lower plate part 71 are welded on the inner surfaces 50A of the sidewall parts 50 in a range L1 on the back sides of lower welding parts 181 welded with the left and right reinforcing plates 75L and 75R.

In addition, the both left and right ends of the lower plate part 71 may be welded on the inner surfaces 50A of the sidewall parts 50 in a range from the lower welding parts 181 to a bending end line 189 where the first bending part 72 ends (on the sides opposite to a below-described bending start line 186). In other words, parts where the lower ends of the left and right reinforcing plates 75L and 75R are in contact with the lower plate part 71 may be welded on the inner surfaces 50A of the left and right sidewall parts 50.

The first bending part 72D is formed in an arc shape (curved shape), both of left and right ends of the first bending part 72D face to the inner surfaces 50A of the sidewall parts 50, and the first bending part 72D is configured as a non-welding part 182 where welding is not performed. Specifically, in a range from the bending start line 186 to the bending end line 189, the first bending part 72D is configured as the non-welding part 182 not welded on the inner surfaces 50A of the left and right sidewall parts 50.

Both of left and right ends of the vertical plate part 73 face to the inner surfaces 50A of the sidewall parts 50 on the laterally same sides, respectively. The both left and right ends of the vertical plate part 73 are welded on the inner surfaces 50A of the left and right sidewall parts 50 on the upper sides of upper welding parts 183 welded and fixed with the left and right reinforcing plates 75L and 75R.

In addition, the both left and right ends of the vertical plate parts 73 may be welded on the inner surfaces 50A of the sidewall parts 50 in a range from the upper welding parts 183 to the bending start line 186. In other words, the parts where the fore ends of the left and right reinforcing plates 75L and 75R are in contact with the vertical plate part 73 may be welded on the inner surfaces 50A of the left and right sidewall parts 50.

Also, the second bending part 72U is formed in an arc shape (curved shape), both of left and right ends of the second bending part 72U face to the inner surfaces 50A of the sidewall parts 50, and the both left and right ends of the second bending part 72U are welded.

As described above, the lower plate part 71 is welded to the bottom wall part 52, and the both left and right ends of the vertical plate part 73 are welded and fixed to the sidewall parts 50, whereby the first and second partitions 70F and 70R are attached inside the boom main body 31.

Meanwhile, in part of at least the vertical plate part 73 of each of the first and second partitions 70F and 70R, the hose hole 85 for inserting the hydraulic hoses H arranged inside the boom main body 31 is formed.

Specifically, the hose hole 85 has a shape that is bored through the laterally central part of the vertical plate 73 throughout a vertical area (the entire area from the upper end to lower end of the vertical plate part 73), successively through the entire areas of the laterally central parts of the first and second bending parts 72D and 72U, and further successively through the lower and upper plate parts 71 and 74. That is, the hose hole 85 extends from the vertically central part of the vertical plate part 73 to the lower plate part 71 through the first bending part 72D, as well as extending from the vertically central part of the vertical plate part 73 to the upper plate part 74 through the second bending part 72U.

More specifically, when viewing the hose hole 85 from the side, one end side of the hose hole 85 is positioned on the lower plate part 71 side lower than the bending start line (a line where the curve starts) 86 at which the first bending part 72D starts, and the other end side of the hose hole 85 is positioned on the upper plate part 74 side higher than the bending start line (a line where the curve starts) 187 at which the second bending part 72U starts. That is, the hose hole 85 extends from the lower end of the vertical plate part 53 to the first bending part 72D, and further extends into the lower plate part 71 in its thickness direction to reach the lower end of the hose hole 85.

An edge part 88 of the hose hole 85 facing to the bottom wall part 52 is configured as a non-welding part not welded to the bottom wall part 52. As illustrated in FIG. 6, the edge part 88 corresponding to the base end of the hose hole 83 extending into the lower plate part 71 (the edge part of the hose hole 85 formed on the lower plate part 71 side) is configured as a part not welded to the bottom wall part 52.

As described above, in the boom main body 31, the partitions 70 (first and second partitions 70F and 70R) are provided on the both sides of the main body bending part 58 inside the boom main body 31, and each of the partitions 70 includes the hose hole 85. For this reason, by moving the fore ends of the hydraulic hoses H, which are inserted from the base end side or fore end side of the boom main body 31 into the boom main body 31, toward the hose hole 85, the hydraulic hoses H can be easily inserted along the longitudinal direction of the boom main body 31.

Also, each of the partitions 70 is formed in the substantially Z-shape including the lower plate part 71, vertical plate part 73, and upper plate part 74, and welded on the inner surfaces of the boom main body 31, and therefore the strength of the whole of the boom can be improved by the partitions 70. In addition, the hose hole 85 is not simply formed in each of the partitions 70, but formed even to the lower plate part 71 via the first bending part 72D between the vertical plate part 73 and the lower plate part 71. For this reason, stress on the first bending part 72D of the partition 70 can be dispersed to avoid stress concentration. Further, the hose hole 85 is formed even to the upper plate part via the second bending part 72U between the vertical plate part 73 and the upper plate part 74, so that the hose hole 85 can be increased in size to easily insert the hydraulic hoses into the boom main body 31, and in addition, stresses on the first and second bending parts 72D and 72U of each of the partitions 70 can be dispersed to avoid stress concentration.

Also, the reinforcing plates 75 are provided, making it possible to improve the rigidities of the partitions, and in addition, the reinforcing plates 75 are welded to the left and right sidewall parts 50, making it possible to improve the strength of the boom main body 31 by the reinforcing plates 75 as well.

Figure 9:
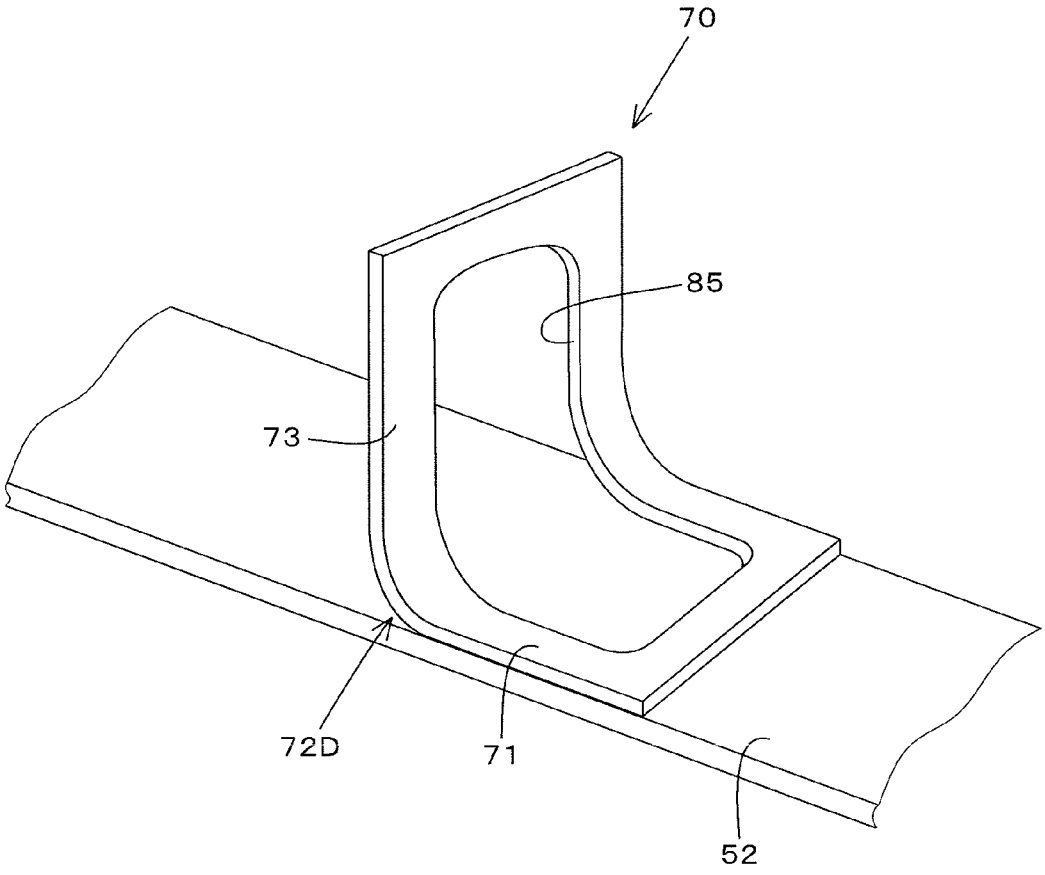
FIG. 9 is a diagram illustrating a variation of a partition in the second embodiment.

FIG. 9 illustrates a variation of each of the partitions 70. As illustrated in FIG. 9, the partition 70 may be formed in a substantially L-shape as viewed from the side so as to include: a lower plate part 71 that is welded to the bottom wall part 52; and a vertical plate part 73 that is raised from the lower plate part 71 and welded to the left and right sidewall parts 50. In this case, desirably, the hose hole 85 is provided in the vertical plate part 73, and extended to the lower plate part 71 from the vertical plate part 73 via a first bending part 72D.

Note that the embodiments disclosed herein are to be considered in all respects as illustrative but not limitative. The scope of the present invention is indicated by the appended claims rather than by the foregoing description, and all changes coming within the meaning and range of equivalency of the claims are intended to be embraced therein.

The partition 70 may be formed in a substantially L-shape as viewed from the side so as to include: a lower plate part 71 that is welded to the bottom wall part 52; and a vertical plate part 73 that is raised from the lower plate part 71 and welded to the left and right sidewall parts 50. In this case, desirably, the hose hole 85 is provided in the vertical plate part 73, and extended to the lower plate part 71 from the vertical plate part 73 via a first bending part 72D.

It is to be understood that although the present invention has been described with regard to preferred embodiments thereof, various other embodiments and variants may occur to those skilled in the art, which are within the scope and spirit of the invention, and such other embodiments and variants are intended to be covered by the following claims.

The invention claimed is:

1. A boom for a working machine, the boom comprising:

a forked base support of which a base end side is pivotally supported by a machine body and a fore end side is connected with a boom main body, the base support comprises:

a body part that has a hose introduction hole for inserting a hydraulic hose from the machine body into the boom main body; and a left and right pair of leg parts that are extended in a forked shape from the body part toward the machine body, and swingably pivotally supported on a machine body side, the body part includes:

sidewalls that are connected with the left and right leg parts;

an upper wall that connects between upper parts of the left and right sidewalls; and a lower wall that connects between lower parts of the left and right sidewalls, and a part surrounded by the left and right sidewalls, the upper wall, and the lower wall is configured as the hose introduction hole, and the upper wall of the body part includes:

an inner surface on a first side that faces the lower wall; and an outer surface on a second side that faces opposite the inner surface;

on the first side of the upper wall of the body part, an enlarged opening part that extends in an upward direction away from the lower wall from the fore end side toward a forked side is formed, and on the second side of the upper wall of the body part, a swelling part that extends in the upward direction away from the lower wall from the fore end side toward the forked side so as to correspond to the first side of the upper wall, and skirt parts that separate in a forked shape and extend downward from a lateral center of a top part of the swelling part toward upper surfaces of the left and right leg parts are formed.

2. The boom for a working machine, according to claim 1, wherein inner surfaces of the left and right sidewalls of the body part are swelled inward to form the sidewalls thicker.

3. The boom for a working machine, according to claim 1 or 2, wherein the sidewalls and the left and right leg parts include: thin wall parts formed by reducing thicknesses of the sidewalls and the leg parts on outer lateral surface sides; and on upper sides of the sidewalls and the left and right leg parts, upper thick wall parts having a larger thickness than the thin wall parts, and a vertical width of the upper thick wall parts is increased from the left and right leg parts toward the sidewalls of the body part.

* * * * *